US005455086A

United States Patent [19]

Quick et al.

[11] Patent Number: 5,455,086

[45] Date of Patent: * Oct. 3, 1995

[54] PAPERBOARD CONTAINER HAVING POLYMETHYLPENTENE COATING

[75] Inventors: James R. Quick, Greenwood Lake, N.Y.; James E. Martin, Mason, Ohio

[73] Assignee: International Paper Company, Purchase, N.Y.

[ * ] Notice: NOTE-DISCLAIMER The portion of the term of this patent subsequent to Oct. 26, 2010 has been disclaimed.

[21] Appl. No.: 118,852

[22] Filed: Sep. 10, 1993

Related U.S. Application Data

[63] Continuation-in-part of Ser. No. 747,834, Aug. 21, 1991, Pat. No. 5,256,427.

[51] Int. Cl.[6] ..... A21D 10/02

[52] U.S. Cl. ..... 428/34.2; 428/479.6; 428/513; 428/35.9; 220/458; 229/903; 426/106; 426/113; 426/126; 426/127

[58] Field of Search ..... 428/479.6, 457.8, 428/34.2, 34.6, 34.7, 511, 512, 513, 537.5, 35.9; 229/190, 902, 903; 427/488, 491, 535, 536, 539; 426/106, 113, 126, 127

[56] References Cited

U.S. PATENT DOCUMENTS

| | | | |
|---|---|---|---|
| 2,648,097 | 8/1953 | Kritchever | 427/223 |
| 2,767,103 | 10/1956 | Loukomsky | 427/223 |
| 4,316,070 | 2/1982 | Prosise | 219/728 |
| 4,622,237 | 11/1986 | Lori | 427/446 |
| 4,818,325 | 4/1989 | Hiraiwa | 156/315 |
| 4,828,136 | 5/1989 | Kawahara | 220/270 |
| 4,853,253 | 8/1989 | Katoh | 427/498 |
| 4,896,788 | 1/1990 | Bolte | 220/359 |
| 4,952,293 | 8/1990 | Sypula | 204/180.7 |
| 5,256,427 | 10/1993 | Quick et al. | 426/106 |

*Primary Examiner*—Charles R. Nold
*Assistant Examiner*—Michael A. Williamson
*Attorney, Agent, or Firm*—Paul R. Juhasz

[57] ABSTRACT

A blank for a paperboard container is provided on one of its surfaces with a layer of food-contacting polymethylpentene. The container formed from the blank, as by bending the blank along fold lines, requires one or more overlapped joints such as the usual manufacturer's joint. To overcome the non-stick properties of the polymethylpentene layer, the layer is flame treated so that it will adhere to a conventional water based, FDA approved adhesive and thereby make possible the formation of a seam or other overlapped joint or joints. Flame treatment is restricted to portions of the area of the polymethylpentene layer that are involved in the formation of the overlapped joint or joints. Alternatives to flame treatment include corona treatment, solvent treatment or treatment of the polymethylpentene surface with a solvent based primer.

3 Claims, 2 Drawing Sheets

FIG. 1
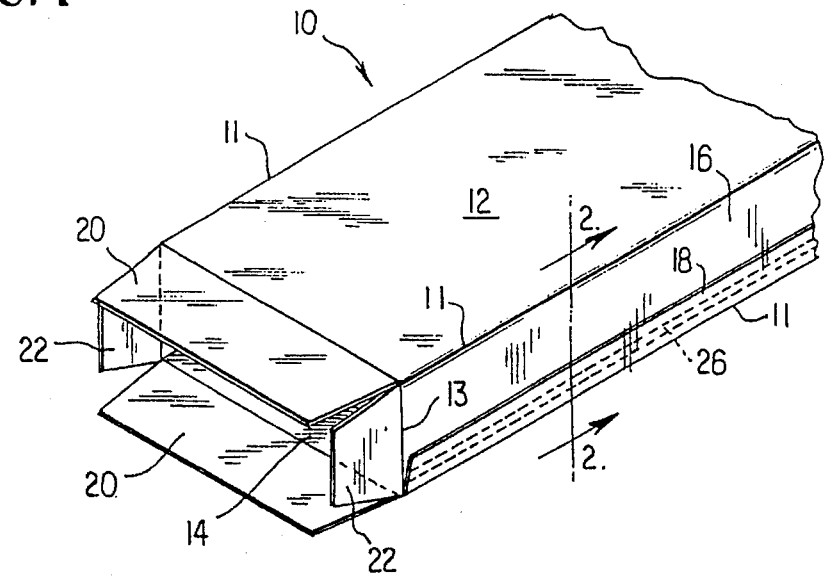
FIG. 2
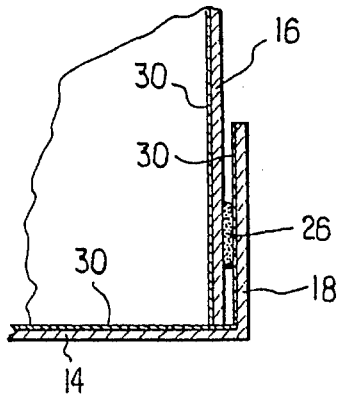
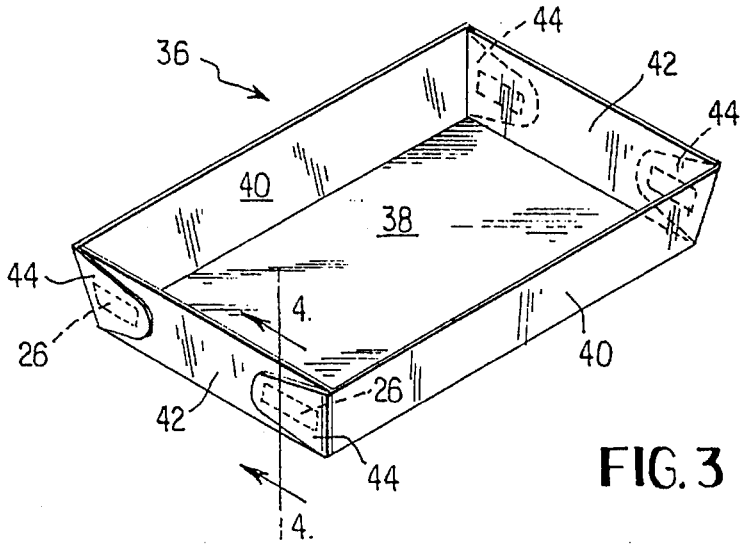
FIG. 3

PAPERBOARD CONTAINER HAVING POLYMETHYLPENTENE COATING

This application is a continuation in part application of application Ser. No. 07/747,834 filed Aug. 21, 1991 by James R. Quick and James E. Martin, now U.S. Pat. No. 5,256,427, and entitled Paperboard Container Having Polymethylpentene Coating.

BACKGROUND OF THE INVENTION

This invention relates to paperboard containers for packaging food products such as frozen entrees, pizza, baked goods, brownies, and the like. Containers of this invention are typically formed from a unitary blank of paperboard or other stiff, bendable, and resilient sheet material. It is known that ovenable food trays may be improved, regarding their anti-sticking properties, by coating their food contacting surface with one or more layers of polymethylpentene, an FDA approved material. This is shown in U.S. Pat. No. 5,002,833 issued to Kinsey et al, dated Mar. 26, 1991. In the formation of an ovenable tray of the type disclosed in the Kinsey patent, it is not necessary to form an overlapped, adhesively secured joint.

The use of a polymethylpentene, food contacting layer in food-containing, folded paperboard containers of conventional design with glued seams, corners or end-flaps has not however been practiced because of the difficulty encountered in making the required overlapped joints. Namely, because of its anti-stick characteristic, it is difficult to adhere a polymethylpentene coated surface with any conventional FDA approved adhesive in forming a container for food. Such adhesives are water based, due to the dangers inherent in solvent based adhesives regarding flammability, exposure of workers to solvent vapors, and potential of food contamination from the solvents. While some FDA approved adhesives are solvent based, their use in food containers would require expensive analytical testing methods/apparatus to insure that no residual solvent was in the adhesive at the time the food was placed in the containers.

SUMMARY OF THE INVENTION

At least one surface of a paperboard blank is coated with a laminate which includes a layer of polymethylpentene, the polymethylpentene layer being most remote from the paperboard substrate. The blank is provided with conventional score/fold lines to permit its bending to form a container for food products. According to the practice of this invention, those portions of the polymethylpentene coating which receive adhesive is flame treated prior to the forming of a container from the blank. This treatment permits paperboard container fabricators to form the usual manufacturer's joint common to many containers, as well as any other type of container requiring adhesively secured overlapped edges or overlapped portions. While flame treatment of polymethylpentene to improve its adhesion is known, the use of flame treatment of this material in the environment of seamed paperboard containers for food is not known.

BRIEF DESCRIPTION OF THE DRAWINGS

FIG. 1 is a partial perspective view of a tube type paperboard container formed in accordance with this invention.

FIG. 2 is a view taken along 2—2 of FIG. 1.

FIG. 3 is a view similar to FIG. 1 and shows another type of paperboard container.

DETAILED DESCRIPTION OF THE INVENTION

Figure 4:
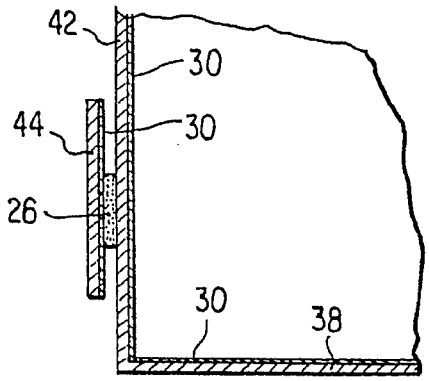
FIG. 4 is a view taken along section 4—4 of FIG. 3.

Referring now to FIG. 1 of the drawings, the numeral 10 denotes generally a paperboard carton or container adapted to contain food and fashioned from a unitary blank of paperboard and coated with a laminate on at least the major part of its inside surface, the laminate including a polymethlypentene layer. Only one end of the container is shown, it being understood that the other end may be the same or different from that illustrated. The blank (shown at FIG. 6) is provided with a plurality of fold or score lines 11 to permit the blank to be folded or erected to form a container. The container shown is known as a tube type container and includes opposite front and rear panels 12 and 14, and side panels 16, only one of which is shown. A manufacturer's flap, integral with rear panel 14, is denoted as 18 and is adhesively secured to one portion of a side panel 16. The manufacturer's flap 18 may be on the outside of the container as shown in FIG. 1, but in some cases it may be on the inside of the container. Elongated end closure flaps 20 are integrally and foldably attached to panels 12 and 14, while shorter end closure flaps 22 are provided on the side panels 16. It will be understood that the other end of the container may be closed by similar closure flaps 20, 22, or by any other closing arrangement.

Referring now to FIG. 2, details of the manufacturer's flap are shown, with a water based adhesive 26 securing manufacturer's flap 18 to a portion of a side panel 16. All of the interior surfaces of the container of FIG. 1, including the interior surfaces of the end closure forming panels 20, 22 are coated with a laminate coating 30 which includes an outer, food-contacting layer of polymethylpentene most remote from the paperboard substrate. Still referring to FIG. 2, it is seen that adhesive 26 adheres to both the polymethylpentene coating on manufacturer's flap 18, and to the right outer surface of end panel 16 which has not been so coated. The seam or joint shown at FIG. 2 is made possible, according to this invention, by flame treating the polymethylpentene layer portions of laminate coating 30 which are involved in the formation of the glued joint. Such flame treatment may be carried out at a place of fabrication of the coated blanks, or alternatively, may be carried out at the place of assembly or erection of the containers from the coated blanks. The flame treatment is confined to the areas of the polymethylpentene layer which are glued with the adhesive. Generally, because the area of flame-treatment cannot be controlled precisely, the flame-treated area will be somewhat greater than the area actually contacting the adhesive 26.

Referring now to FIG. 3 of the drawings, the numeral 36 denotes a tray type container, also typically fashioned from a unitary blank of paperboard coated on its interior or food-contacting surface with a laminate containing one or more layers of polymethylpentene. This container does not contain the usual manufacturer's flap, but does require overlapped and glued paperboard layers. The bottom panel of the tray is designated as 38, with the long side walls designated as 40 and the shorter side walls designated as 42. Flaps 44 are integral with long walls 40, with the inside portions of these flaps being adhesively secured to shorter tray walls 42, as shown at FIG. 4. Adhesive 26 of FIG. 4 is seen to join the polymethylpentene layer of coating 30 on flaps 44 to the left side of sidewalls 42. Again, all of the interior surfaces of the tray are provided with coating 30, as well as the interior surfaces of flaps 44. Only those portions of the polymethylpentene layer glued with adhesive are flame treated. No portions of the food contacting interior surface of the container are flame treated.

It is important that the flame treatment of the polymethylpentene surface be confined generally to those portions of the area of the polymethylpentene layer that are involved in the formation of the glued seams, corners, end-flaps, or other overlapped joints of the paperboard food container. More specifically, it is important that the flame treatment not extend into areas of the blank that will be food-contacting areas on the interior of the container. If such food-contacting areas are flame-treated, the excellent food-release, anti-sticking properties of the polymethylpentene layer are destroyed. Only by controlling the area of flame-treatment so that it is exclusive of the food-contacting areas of the container is it possible to fabricate a glued container that has the food release characteristics afforded by an unaltered polymethylpentene layer. The prior art that is concerned with improving the adhesive receptivity of polymethylpentene does not address a situation where it is also important to maintain the low surface energy required for the release of foods that tend to stick to cooking surfaces.

Figure 5:
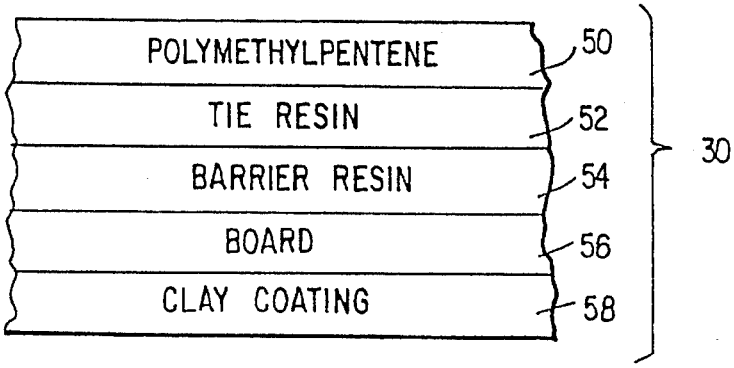
FIG. 5 is a cross sectional view of a typical laminate containing a layer of polymethylpentene coated on a paperboard substrate.

Referring now to FIG. 5, a somewhat schematic view of laminated coating 30 is illustrated. The upper or food-contacting layer of laminated coating 30 is designated as 50 and is a layer of polymethylpentene. A tie resin layer 52 is immediately beneath layer 50, with a barrier layer 54 coated on paperboard substrate 56, such that the paperboard substrate 56 and tie resin layer 52 sandwich the barrier layer 54. Optionally, a conventional clay-filled coating 58 may be applied to the bottom of paperboard substrate 56. If a clay-filled coating such as 58 is employed, it would be on the right hand surface of panel 16 of FIG. 2 and on the left hand surface of wall 42 of FIG. 4, as well as on the right hand surface of manufacturer's flap 18 of FIG. 2 and on the left hand surface of flaps 44 of FIG. 4. The use of a clay-filled coating in the paperboard container art is known, and the presence or absence of such a coating plays no role in this invention.

Figure 6:
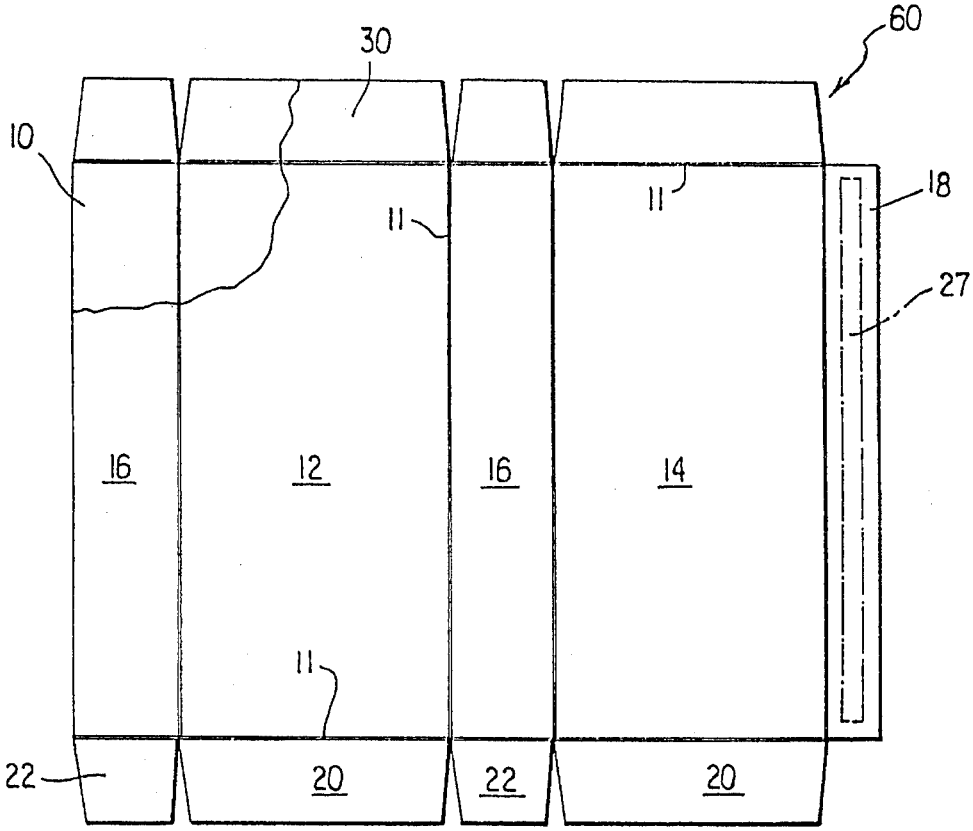
FIG. 6 is a plan view at a unitary, coated paperboard blank for forming the container of FIG. 1.

Referring now to FIG. 6, a blank for forming the container of FIG. 1 is illustrated, the blank denoted as 60. The interior forming surface of the blank faces the reader and is coated with laminate 30. Manufacturer's flap 18 has been flame treated, and this zone or area of flame treatment within flap 18 is denoted as 27. While shown as perfectly rectangular, zone 27 will not be absolutely rectangular. In practice, the adhesive 26 of FIG. 2 will not cover the entire area of zone 27.

The composition and manner of application of layers 50, 52, and 54 to the paperboard substrate 56 are disclosed in the noted patent to Kinsey et al, hereby incorporated by reference. The reader will note that FIG. 5 is taken largely from FIG. 2 of Kinsey et al, with the three layer coextrusion 32 of Kinsey et al corresponding generally to laminate 30 of this invention. Also as shown in Kinsey et al, FIG. 1 thereof illustrates a plural laminate coating including two polymethylpentene layers. A laminate coating such as shown at FIG. 1 of the Kinsey et al patent may also be employed as the coating 30 shown at the present FIG. 5. It will also be understood that a clay-filled coating, similar to coating 58 of FIG. 5, may be used on, in this invention, the lower surface of an extrusion-coated paperboard similar to that shown at FIG. 1 of the Kinsey et al patent.

A specific example of the method of flame treating and of the adhesives which may be employed is as follows. The adhesive 26 was a water based acrylic copolymer, trade designated as Air Products Flexbond 165. Alternatively, a water based vinyl acetate/ethylene/acrylic terpolymer adhesive, trade designated as Flexbond 153, also by Air Products, may be used. The flame was that from a Bunsen burner, with the polymethylpentene layer turned downwards, facing the flame and just above the bright blue flame portion. The polymethylpentene layer was moved at a speed of about one foot per second across the flame. The adhesive was then applied to the flame treated areas, and the opposite side of the paperboard substrate which was coated with a clay-filled coating such as 58, was pressed thereagainst.

Flame treatment is a preferred method for preparing the surface of polymethylpentene coated paperboard for gluing with water-based adhesives because the method provides consistent results, it does not require expensive equipment and the effects of flame treatment are sufficiently permanent to permit flame treatment of the paperboard stock at one location and shipment to another location for the final steps of container fabrication, including gluing. However, in some cases flame treatment may not be an acceptable method. For example, in some situations there may be a concern about the use of an open flame because of the possibility of igniting the paperboard under certain manufacturing conditions. In some other situations, flame treatment is not a viable option because of the absence of a gas supply. Alternative methods for gluing polymethylpentene coated paperboard that do not involve flame treatment have been discovered and these methods will now be discussed in detail.

One alternative method for producing paperboard containers with polymethylpentene inner surfaces, with glued seams, corners or end flaps utilizes corona treatment of the polymethylpentene surface to raise the surface energy and make that surface receptive to water-based adhesives. Containers of the general designs shown in FIGS. 1 and 3 can be produced with glued joints such as those shown in FIGS. 2 and 4 when the polymethylpentene surface 30 is first corona treated in the area of the glue joint. As has been discussed concerning flame treatment, the area of the container blank that is corona treated, such as area 27 in FIG. 6, should be confined to an area exclusive of the food contacting portions of the container. Aside from the substitution of corona treatment for flame treatment, all of the previously stated aspects of container design and fabrication apply to this alternative method. For example, a paperboard stock with a laminated coating with a polymethylpentene surface layer was corona treated using a standard commercial corona treating system available from Softal of America, Pawtucket, R.I. Samples were produced with the polymethylpentene surface corona treated to raise the surface energy to above 50 dyne/cm, versus less than 32 dyne/cm for the original untreated polymethylpentene surface. Glued joints were produced by applying the aforementioned adhesive, Air Products Flexbond 165, to the corona treated polymethylpentene surface and then pressing the adhesive coated surface against the opposite clay coated surface of the paperboard. This method provided fiber-tearing glued joints that withstood exposure to freezer and oven conditions, −10° F. and +300° F. respectively.

Another alternative method for producing paperboard containers with polymethylpentene inner surfaces, with glued seams, corners or end-flaps utilizes treatment of the polymethylpentene surface with an organic solvent to make that surface receptive to water-based adhesives. All of the previously discussed aspects of container design and manufacture are applicable to this alternative method, including the constraint that the area that is treated for glueability should be exclusive of any food contacting areas of the container. Glued joints of the types shown in FIGS. 2 and 4 can be produced by this method. The area of the polymethylpentene surface 30 that is solvent treated will generally comprise a portion of the total area of a flap, such as area 27 shown in FIG. 6. The treatment process can consist of simply wiping the polymethylpentene surface with a cotton applicator soaked with the solvent and then allowing the surface to air dry. Other methods for applying the solvent to the polymethylpentene surface, such as printing, spraying or dipping, may be used. The solvent should be one that will readily wet the polymethylpentene surface. Absorption of the solvent into the polymethylpentene provides a transient modification that makes the surface more receptive to water-based adhesives. For example, a paperboard stock with a laminated coating with a polymethylpentene surface layer was treated with n-hexane and air dried, and then glued to a clay coated paperboard surface using Air Products Flexbond 165 water-based adhesive. The resulting joint exhibited fiber tearing adhesion. This solvent treatment method does not provide the marked increase in the surface energy of the polymethylpentene surface that is obtained with corona treatment, but the required improvement in glueability is obtained nonetheless.

Another alternative method for producing a paperboard container with polymethylpentene inner surface, with a glued seam, corners or end-flaps utilizes a solvent based primer treatment applied on the polymethylpentene surface. The primer treatment process consists of first preparing a solution or dispersion of a polar organic polymer in an organic solvent, then applying a coating of this solution or dispersion on the polymethylpentene surface in the area that will be glued, and allowing the treated area to air dry. The polar organic polymer should be one with polar functional groups such as ester groups that will provide a surface that is receptive to a water-based adhesive. The polar organic polymer must also be soluble in a solvent that will readily wet the polymethylpentene surface. Esters of tall oil rosins, such as the Zonester products of Arizona Chemical, Panama City, Fla. meet the requirements just described for the polar organic polymer to be used in the preparation of a solvent based primer for use on polymethylpentene coated paperboard. For example, a primer treatment solution was prepared from 25 parts Zonester 100, a high melting pentaerythritol ester of tall oil rosin, dissolved in 75 parts n-hexane. This primer treatment solution was applied with a 200 line flexographic hand proofer, to provide a light coating on the polymethylpentene surface of a paperboard stock having a laminated coating with a polymethylpentene surface layer. Glued joints were produced by applying either of the previously described water-based adhesives from Air Products, Flexbond 153 or Flexbond 165, to the primer-treated polymethylpentene surface and then joining that surface with a clay coated paperboard surface, resulting in fiber tearing bonds within 40 seconds. In this method, the primer treatment solution will generally be applied to a restricted area of a flap, such as area 27 shown in FIG. 6, exclusive of any food contacting portions of the container, such as the interior portions of the containers shown in FIGS. 1 and 3.

We claim:

1. A unitary paperboard blank for forming a food container, said blank provided with a plurality of fold lines to permit it to be folded into a container for a food product, the blank having a laminated coating on at least the major portion of one surface thereof, said coating including a food contacting polymethylpentene layer most remote from the paperboard, the blank including a flap coated with said laminate for the formation of an overlapped joint, the flap having a portion of the polymethylpentene layer thereon corona treated, to thereby increase the adhesion of the polymethylpentene layer on said flap to a water based adhesive.

2. A paperboard food container formed from a unitary blank of paperboard, the container having a plurality of flat wall panels integrally joined along fold lines, a flap extending from the edge of one of two adjacent said wall panels, said flap overlapping the second of said two adjacent wall panels to form an overlapped joint, the interior of the container coated over at least a portion thereof with a laminate, that layer of the laminate most remote from the paperboard being a food contacting polymethylpentene and forming the interior surface of said container, one surface of said overlapped joint defined by said polymethylpentene layer, a portion of said polymethylpentene layer of said overlapped joint being corona treated, said overlapped joint being secured with a water based adhesive, said water based adhesive contacting both said corona treated polymethylpentene layer of said overlapped joint and a portion of the opposite surface of said unitary blank of paperboard.

3. The container of claim 2 including a food product therein.

* * * * *